US007050004B2

(12) United States Patent
Shafai et al.

(10) Patent No.: US 7,050,004 B2
(45) Date of Patent: May 23, 2006

(54) MULTIPLE FREQUENCY ANTENNA

(75) Inventors: Lotfollah Shafai, Winnipeg (CA); Cyrus Shafai, Winnipeg (CA)

(73) Assignee: University of Manitoba, Winnipeg (CA)

( * ) Notice: Subject to any disclaimer, the term of this patent is extended or adjusted under 35 U.S.C. 154(b) by 0 days.

(21) Appl. No.: 10/509,099

(22) PCT Filed: Mar. 28, 2003

(86) PCT No.: PCT/CA03/00446

§ 371 (c)(1),
(2), (4) Date: Sep. 27, 2004

(87) PCT Pub. No.: WO03/083988

PCT Pub. Date: Oct. 9, 2003

(65) Prior Publication Data

US 2005/0179592 A1 Aug. 18, 2005

Related U.S. Application Data

(60) Provisional application No. 60/367,748, filed on Mar. 28, 2002.

(30) Foreign Application Priority Data

Mar. 28, 2002 (WO) ..... PCT/CA02/00423

(51) Int. Cl.
*H01Q 1/38* (2006.01)

(52) U.S. Cl. ..... 343/700 MS; 343/745

(58) Field of Classification Search ..... 343/700 MS, 343/702, 745, 749
See application file for complete search history.

(56) References Cited

U.S. PATENT DOCUMENTS

| | | | | |
|---|---|---|---|---|
| 5,646,634 | A * | 7/1997 | Bokhari et al. | 343/700 MS |
| 5,917,450 | A * | 6/1999 | Tsunekawa et al. | 343/700 MS |
| 6,297,776 | B1 * | 10/2001 | Pankinaho | 343/700 MS |
| 6,473,042 | B1 * | 10/2002 | Fang et al. | 343/700 MS |
| 6,633,261 | B1 * | 10/2003 | Iwai et al. | 343/700 MS |
| 6,819,290 | B1 * | 11/2004 | Hani et al. | 343/700 MS |

* cited by examiner

*Primary Examiner*—Tan Ho
(74) *Attorney, Agent, or Firm*—Thomas Adams

(57) ABSTRACT

An antenna having a resonant structure, comprises an antenna element (11) and an adjacent electrode (17A) and control means (22,25) for changing a resonance frequency of the antenna element. The control means may comprise a conductive membrane (17A) spaced from the antenna element. The resonance frequency then is changed by flexing the membrane, conveniently by applying a potential difference between the membrane and an adjacent control electrode.

17 Claims, 2 Drawing Sheets

MULTIPLE FREQUENCY ANTENNA

CROSS-REFERENCE TO PRIOR APPLICATIONS

This application claims priority from International patent application No. PCT/CA02/00423 filed Mar. 28, 2002, and U.S. Provisional patent application No. 60/367,748 filed Mar. 28, 2002, the contents of which are incorporated herein by reference.

TECHNICAL FIELD

This invention relates to antennas that are tunable over a range of operating frequencies and is especially applicable to antennas for wireless communications devices.

BACKGROUND ART

Wireless communications devices, which include cellular/mobile telephones, portable telephones, global satellite communications transceivers, paging devices, so-called personal digital assistants, laptop/notebook computers, and so on are proliferating. It is sometimes desirable for antennas of such devices to be capable of operation at different frequencies. For example, as explained in U.S. Pat. No. 6,204,826, cellular/mobile telephones may need to operate within different systems, such as the Global System of Mobile communications (GSM), which typically uses a frequency band from 880 MHz to 960 MHZ, and the Digital Communications System (DCS) which typically uses a band between 1710 MHz and 1880 MHz.

Antennas of portable/mobile equipment must be relatively small, so they usually are relatively narrowband. It is known, therefore, to design such antennas to have more than one resonance frequency, facilitating operation in more than one frequency band. Thus, U.S. Pat. No. 6,204,826 discloses an antenna comprising a meandering conductive trace formed upon a dielectric substrate. The trace comprises two segments which couple with each other to provide two distinct resonance frequencies. Likewise, US published patent application number 2002/0014996 discloses an antenna having a resonator element to which the signal feed can be connected at different locations according to the frequency range at which the antenna is to operate.

These arrangements are not entirely satisfactory, however. A cellular telephone system might assign different frequencies to different cells and/or users. In a similar manner, a portable domestic telephone might be capable of selecting different channels within a prescribed band for communication with its own base station. In either case, the antenna still must be sufficiently broadband to accommodate the whole of the band concerned, which limits sensitivity and/or range. Wireless systems generally have limited bandwidth, and numbers of users are increasing rapidly, so co-channel interference is a major problem. Consequently, there is a need for an antenna which can provide satisfactory performance over a range of frequencies which may be within one or more frequency bands. A further disadvantage of such known antennas is that the number of different frequencies is limited.

An object of the present invention is to at least ameliorate the problems associated with such known antennas, or at least provide an alternative.

SUMMARY OF THE INVENTION

According to one aspect of the present invention, there is provided an antenna element, an adjacent flexible metal electrode and control means for effecting a dimensional change of the antenna element and/or between the antenna element and the flexible metal electrode so as to adjust a resonance frequency of the antenna and tune the antenna for operation at different frequencies.

The flexible metal electrode may comprise a ground plane for the antenna. Alternatively, the electrode may be provided in addition to a ground plane.

The electrode may comprise at least one conductive membrane, the antenna element overlying the membrane, possibly with a space therebetween, and the control means may effect a change in the spacing between the membrane and the antenna element, thereby to alter the resonance frequency of the antenna element.

The means for effecting a change in spacing may comprises a second electrode and circuitry for applying a potential difference between the membrane and the second electrode so as to deflect the membrane electrostatically relative to the electrode.

BRIEF DESCRIPTION OF THE DRAWINGS

An embodiment of the invention will now be described by way of example only and with reference to the accompanying drawings in which.

DETAILED DESCRIPTION OF PREFERRED EMBODIMENTS

Figure 1:
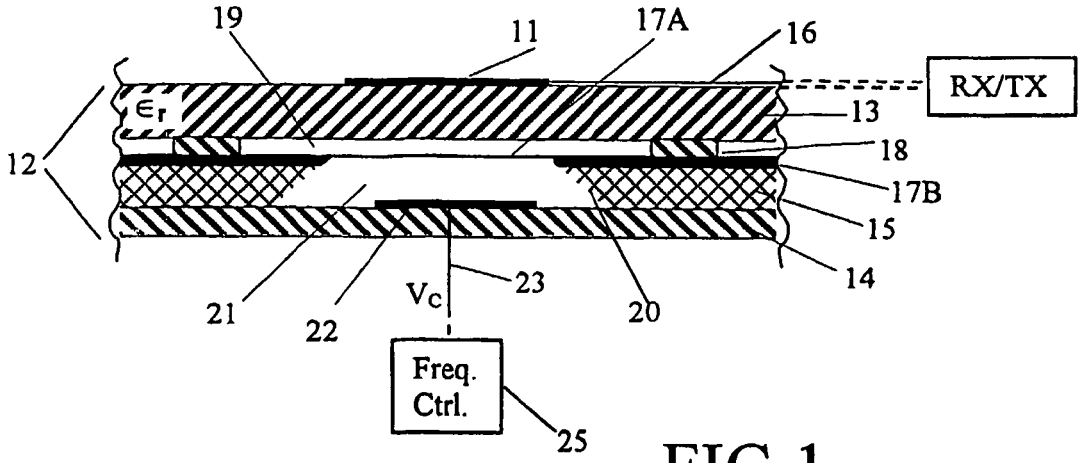
FIG. 1 is a detail sectional side view of an antenna element having a flexible membrane for tuning of the antenna over a continuous range of resonance frequencies.
Figure 2:
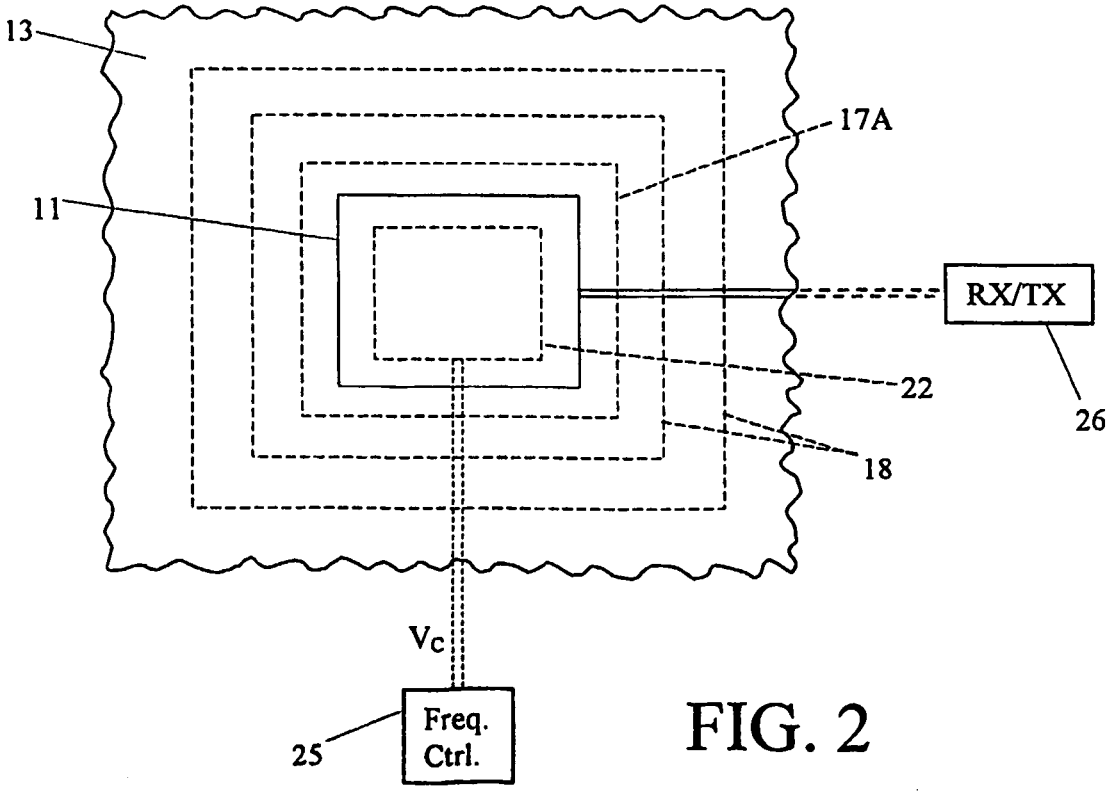
FIG. 2 is a plan view of the antenna element.

Referring to FIGS. 1 and 2, an antenna comprises an antenna element, in the form of a microstrip patch antenna element 11, formed upon the surface of a multilayer printed circuit board 12 having an uppermost dielectric layer 13, a lowermost dielectric layer 14, and a middle dielectric layer 15. The materials used for the layers may be whatever is suitable for the fabrication process to be used. For example, if chemical etching (micromachining) is to be used, the layer may be glass. Alternatively, if numerically controlled machining is used, the layers might be other insulating material, such as a combination of Teflon and fiberglass, as marketed under the trade mark Duroid.

A microstrip feed line 16, also formed upon the surface of layer 13, couples the antenna element 11 to a transmitter/receiver 26 which communicates RF signals to/from the antenna element 11. For the purposes of description, it will be assumed that the antenna is used to transmit signals, in which case the antenna element 11 is a radiator element, but it will be appreciated that it could be used to receive signals too.

A rectangular conductive ground plane 17 having a very thin central membrane portion 17A and thicker margins 17B extends subjacent the dielectric substrate 13 and is spaced from its lower surface by a thin rectangular spacer 18 having a central opening leaving a narrow air gap 19 between the underside of the dielectric substrate 13 and the membrane portion 17A. The membrane portion 17A may be a thin metal film, such as copper, or a dielectric film with thin metallisation layers on its opposite surfaces.

The ground plane 17 lies upon the upper surface of the middle dielectric layer 15 which itself is supported by the third, lowermost dielectric layer 14. The second dielectric layer 15 has a central rectangular opening 20, conveniently formed by chemical etching or micromachining, forming a cavity 21 extending between the underside of the membrane portion 17A and the upper surface of the lowermost dielectric layer 14.

A plate electrode 22, conveniently formed by metallisation, is provided within the cavity upon the upper surface of the lowermost dielectric layer 14.

The plate electrode 22 is connected by way of a control line 23 to a frequency controller 25 which applies a (d.c.) control voltage $V_C$ between the electrode 21 and the ground plane 17, and hence the conductive membrane portion 17A. When the control voltage $V_C$ is applied, the resulting electrical force between the electrode 22 and the membrane portion 17A causes displacement of the membrane portion 17A towards to the electrode 22, and thereby increasing the thickness of the air gap 19 between the membrane portion 17A and the underside of the uppermost dielectric substrate 13. This reduces the effective permittivity of the substrate beneath the microwave patch antenna element 11 and increases its resonance frequency. The radiated field of the patch antenna element 11 experiences an electrical phase change, the magnitude of which is proportional to the displacement of the membrane portion 17A, and therefore dependent upon the magnitude of the control voltage $V_C$.

Of course, a converse arrangement could be used, with the membrane portion 17A being drawn away from the electrode 22 and decreasing the thickness of the air gap 19.

It should be noted that the spacer 18, and the air gap 19 it creates, are optional. The membrane 17A could lie directly against the dielectric substrate 13 and be drawn away from it to create the change in resonance frequency.

Air holes may be provided in the uppermost dielectric substrate 13 and/or the lowermost dielectric substrate 14 and/or the flexible metal electrode itself, so as to avoid pressure or vacuum effects resisting movement of the membrane 17A.

It should also be noted that the dielectric layers 13 and 14 and the ground plane 17, with membrane 17A, separate the circuitry for applying the control voltage $V_C$ electrically from the radio frequency circuitry, i.e., the microwave patch antenna element 11 and the feed line 12. Hence, there is an inherent isolation between the control and radio frequency signals, improving the reliability and reducing the cost of implementation.

It should be appreciated that more than one membrane could be used, rather than one.

Also, the spacer 18 could be integral with either the upper dielectric layer 13 or the thicker margin portions 17B of the ineinbraneous ground plane 17.

It is also envisaged that the flexible metal electrode could be displaced using alternative means, e.g. pneumatic, hydraulic thermal, mechanically squeezed cavity walls. For example, either of the cavities 19 and 21 could be sealed and fluid-filled and connected to a pump allowing the pressure in that cavity to be changed relative to the pressure in the other cavity, causing displacement of the flexible metal electrode. The fluid could be gas or air.

Of course, this would not be appropriate if the flexible metal electrode were perforated, as described above, or had slits along its margins as described below.

Figure 3:
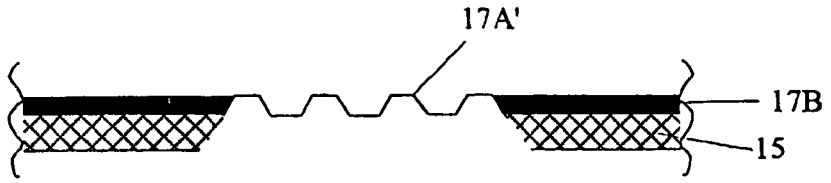
FIGS. 3 and 4 are sectional views of alternative membranes.
Figure 4:
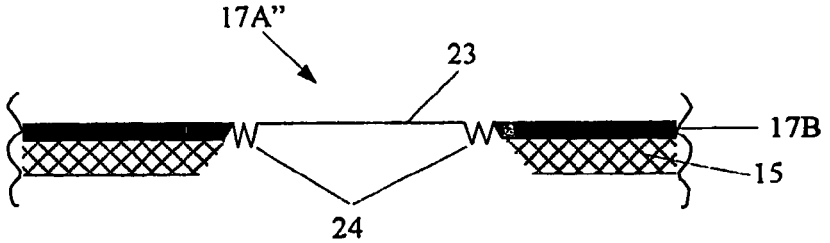

Although the membrane shown in FIG. 1 is flat, other configurations are feasible. For example, FIG. 3 shows a corrugated membrane 17A', and FIG. 4 shows a membrane 17A" having a flat middle section 23 and a corrugated margin 24. In either case, the corrugations allow the membrane to move without necessarily stretching. Thus, these and other suitable configurations could be used to increase the allowable range of membrane displacement, thus enabling a greater range of operating frequencies.

Moreover, the connection between the flexible metal electrode and its support, eg. dielectric layer 15, need not be continuous. Indeed, connecting it at intervals may reduce the force needed to move the flexible metal electrode a given distance. Thus, the marginal portions of the flexible metal electrode could have slits alternating with "live hinges". The live hinges could comprise corrugations or other configurations, as before. A preferred configuration would be a rectangular (square or oblong) flexible metal electrode connected to the support by only two opposite edges, advantageously using corrugations or other "hinge" configurations affording adequate movement without stretching.

Thermal control of electrode displacement could be achieved by thermal expansion of the flexible metal electrode itself, or by differential thermal expansion in the case of a laminated electrode arrangement. Thermal heating could be achieved by a number of means, such as a microheater on/in the flexible metal electrode, or by means for shining laser or other focussed/high intensity light onto the electrode and/or its hinges or even by passing a D.C. electrode current through ground plane 17.

Figure 5:
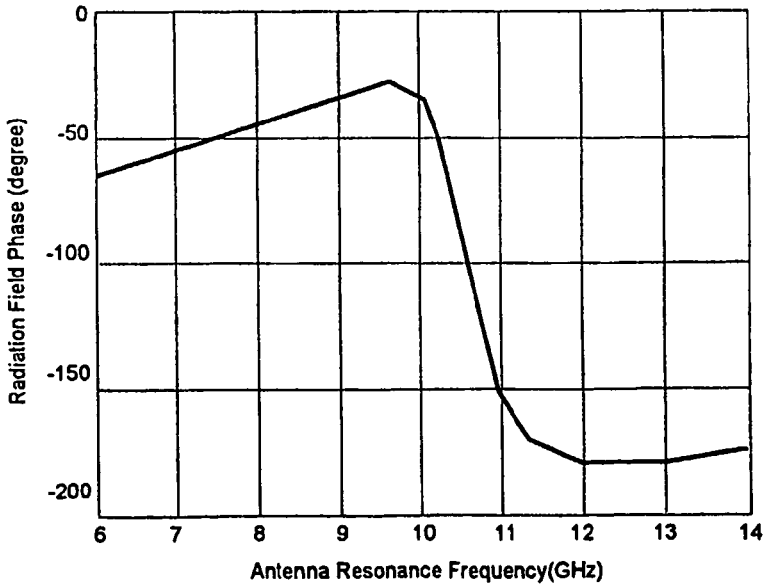
FIG. 5 is a graph illustrating change in phase with respect to frequency for the antenna element as the membrane is flexed.

FIG. 5 illustrates, as an example, a graph of the relationship between the radiated field phase and the antenna resonance frequency for a patch antenna element 11 carried by a substrate 13 having a dielectric constant of about 4. The graph shows a change in phase of about 150 degrees for a change in frequency from about 10 Ghz to about 11 GHz caused by deflecting the membrane by about one millimetre on average. (N.B. The membrane will deflect by different amounts across its width).

While the concomitant change in phase is not of concern here because a single antenna element is involved, it is of significance where a plurality of antenna elements of the kind disclosed herein are employed in a phased array antenna.

The invention is predicated upon the fact that most antenna elements, such as microwave patches and dipoles, are resonant structures and the resonance frequency is dependent upon the dimensions. It is possible, therefore, to preferentially modify the resonance frequency of the antenna elements. The required dimensional/geometrical modifications are facilitated by micromachining the microstrip patch, or its ground plane, and then using DC voltages to implement the required dimensional/geometrical modifications.

Although the above-described embodiment effects the dimensional/geometrical modifications by flexing a membrane subjacent a patch, it should be appreciated that they could be achieved in other ways. For example, the required dimensional/geometrical modifications could include changing the size of the patch, or its distance from the ground plane, or the location of its feed, or introducing a shorting pin between the patch and its ground plane; or any other change which would effect the required change in resonance frequency.

Thus, it would be possible to move the antenna instead of, or in addition to, the membrane in order to effect the change in the resonance frequency.

The antenna elements could be dipoles or other suitable elements whose equivalent circuit is a tuned circuit.

INDUSTRIAL APPLICABILITY

Adjustment of the resonant frequency of an antenna element it to be used for a range of frequencies, or for different bands, e.g., 11.5 GHz to 12.5 GHz. Advantageously, this would reduce the need for a broadband antenna which would receive more noise and require filtering. Embodiments of the invention can be fabricated using techniques or processes similar to those used to create integrated circuits or/and microstrip antennas.

The invention claimed is:

1. An antenna comprising an antenna element (11), an adjacent flexible metal electrode (17A) and control means (22) for effecting a dimensional change of the antenna element and/or between the antenna element and the flexible metal electrode so as to adjust a resonance frequency of the antenna and tune the antenna for operation at different frequencies, wherein the flexible metal electrode comprises a membrane (17A) overlain by the antenna element (11) and the control means comprises means (22) for effecting a change in spacing between the antenna element and flexible metal electrode.

2. An antenna according to claim 1, wherein the flexible metal electrode comprises a ground plane (17).

3. An antenna according to claim 1, wherein the flexible metal electrode (17A) comprises a single metal film.

4. An antenna according to claim 1, wherein the flexible metal electrode (17A) comprises at least one conductive coating on a surface of a flexible insulating/dielectric film.

5. An antenna comprising an antenna element (11), an adjacent flexible metal electrode (17A) and control means (22) for effecting a dimensional change of the antenna element and/or between the antenna element and the flexible metal electrode so as to adjust a resonance frequency of the antenna and tune the antenna for operation at different frequencies, wherein the means for effecting dimensional change comprises circuitry for applying a potential difference ($V_C$) between the flexible metal electrode and a second electrode so as to defied the flexible metal electrode electrostatically relative to the second electrode.

6. An antenna comprising an antenna element (11), an adjacent flexible metal electrode (17A) and control means (22) for effecting a dimensional change of the antenna element and/or between the antenna element and the flexible metal electrode so as to adjust a resonance frequency of the antenna and tune the antenna for operation at different frequencies, wherein the means for effecting a dimensional change comprises means for applying a pneumatic force upon the flexible metal electrode (17A) so as to deflect the electrode relative to the antenna element.

7. An antenna comprising an antenna element (11), an adjacent flexible metal electrode (l7A) and control means (22) for effecting a dimensional change of the antenna element and/or between the antenna element and the flexible metal electrode so as to adjust a resonance frequency of the antenna and tune the antenna for operation at different frequencies, wherein the means for effecting a dimensional change comprises a means for applying thermal heating or cooling to effect thermal expansion or contraction and induce bonding of the flexible metal electrode (17A) so as to deflect the electrode relative to the antenna element.

8. An antenna comprising an antenna element (11), an adjacent flexible metal electrode (17A) and control means (22) for effecting a dimensional change of the antenna element and/or between the antenna element and the flexible metal electrode so as to adjust a resonance frequency of the antenna and tune the antenna for operation at different frequencies, wherein the flexible metal electrode (17A) comprises a laminate fabricated from layers of conducting metal and/or non-conducting dielectric.

9. An antenna comprising an antenna element (11), an adjacent flexible metal electrode (17A) and control means (22) for effecting a dimensional change of the antenna element and/or between the antenna element and the flexible metal electrode so as to adjust a resonance frequency of the antenna and tune the antenna for operation at different frequencies, wherein the flexible metal electrode (17A) is perforated.

10. An antenna comprising an antenna element (11), an adjacent flexible metal electrode (17A) and control means (22) for effecting a dimensional change of the antenna element and/or between the antenna element and the flexible metal electrode so as to adjust a resonance frequency of the antenna and tune the antenna for operation at different frequencies, wherein the flexible metal electrode is connected to a support by a plurality of hinge portions.

11. An antenna according to claim 10, wherein the flexible metal electrode comprises a medial portion and at least two integral hinge portions whereby the medial portion is attached to the support, the hinge portions flexing to allow movement of the medial portion relative to the antenna.

12. An antenna according to claim 10, wherein the medial portion is rectangular and the hinge portions are at opposite sides thereof.

13. An antenna according to claim 10, wherein the hinge portions are corrugated.

14. An antenna comprising an antenna element (11), an adjacent flexible metal electrode (17) and control means (22) for effecting a dimensional change of the antenna element and/or between the antenna element and the flexible metal electrode so as to adjust a resonance frequency of the antenna and tune the antenna for operation at different frequencies, wherein the flexible metal electrode (17A) is non-planar.

15. An antenna according to claim 14, wherein at least a medial portion of the flexible metal electrode (17A') is corrugated.

16. An antenna according to claim 14, wherein the flexible metal electrode (17A') has a flat middle portion (23) and corrugated marginal portion (24).

17. An antenna comprising an antenna element, a flexible metal electrode, a second electrode and control means, the flexible metal electrode comprising a membrane extending between the antenna element and the second electrode and the control means comprising circuitry for establishing a potential difference between the flexible metal electrode and the second electrode so as to deflect the flexible metal electrode electrostatically relative to the second electrode and antenna element and thereby adjust a resonance frequency of the antenna.

* * * * *